US006997155B1

(12) United States Patent
Lu

(10) Patent No.: US 6,997,155 B1
(45) Date of Patent: Feb. 14, 2006

(54) ENGINE STARTING STRUCTURE FOR REMOTE-CONTROL TOY CAR

(76) Inventor: Ke-Way Lu, 3F, No. 322, Sec. 6, Min-Chuan East Road, Taipei City (TW)

( * ) Notice: Subject to any disclaimer, the term of this patent is extended or adjusted under 35 U.S.C. 154(b) by 0 days.

(21) Appl. No.: 11/004,717

(22) Filed: Dec. 2, 2004

(51) Int. Cl.
*F02N 17/00* (2006.01)

(52) U.S. Cl. ..... 123/179.25; 74/6

(58) Field of Classification Search ..... 123/179.25, 123/179.27, 179.24; 74/6
See application file for complete search history.

(56) References Cited

U.S. PATENT DOCUMENTS 5,095,865 A * 3/1992 Keister ..... 123/179.5
6,532,908 B1 * 3/2003 Wang ..... 123/41 E
6,857,331 B1 * 2/2005 Yeh ..... 74/7 C
2003/0079558 A1 * 5/2003 Muehlbauer ..... 74/6
2004/0065161 A1 * 4/2004 Yeh ..... 74/6
2004/0134293 A1 * 7/2004 Lai ..... 74/6

* cited by examiner

*Primary Examiner*—Henry C. Yuen
*Assistant Examiner*—Arnold Castro
(74) *Attorney, Agent, or Firm*—Ladas & Parry, LLP

(57) ABSTRACT

An engine starter structure for remote-control toy car is disclosed to include a cylinder block, a coupling block mounted inside the cylinder block and connected to the output shaft of the engine of the remote-control toy car, a side cover covering the cylinder block, and a starter block, which is mounted inside the cylinder block of the engine and engaged with a rod at the coupling block and has a coupling tube with a serrated front coupling edge suspending in the center through hole of the side cover for receiving the starting rod of a small electric engine starter for rotating the coupling block and the output shaft to start the engine.

2 Claims, 7 Drawing Sheets

ENGINE STARTING STRUCTURE FOR REMOTE-CONTROL TOY CAR

BACKGROUND OF THE INVENTION

1. Field of the Invention

The present invention relates an engine for remote-control toy car and more specifically, to an engine starting structure for remote-control toy car, which enables the user to start the engine with a small electric engine starter easily and which automatically forces the starting rod of the small electric engine starter out of the engine after start of the engine.

2. Description of the Related Art

The engines used in regular engine-operated remote-control toy cars are developed through several generation improvements. The engine for remote-control toy car of the first generation is to be started with a drag rope. This design is difficult to start, and the drag rope may break easily. FIGS. 1 and 2 show an engine for remote-control toy car of the first generation. According to this design, the engine 1 comprises a cylinder block 10, a bearing holder 11, a coupling device 12, an one-way bearing 13, and a cover 14. The bearing holder 11 is mounted inside the cylinder block 10 and connected to the engine's output shaft 102. The one-way bearing 13 is mounted in the bearing holder 11. The coupling device 12 is coupled to the one-way bearing 13. The cover 14 is covered on the cylinder block 10. The cover 14 has a pull handle 141, which is connected to a winding (not shown) inside the cover 14 through a rope (not shown). This design of engine is still not satisfactory in function. One drawback of this design of engine is its complicated structure. Another drawback of this design of engine is that the rope tends to break during operation. Still another drawback of this design of engine is that the one-way bearing wears quickly with use.

In order to eliminate the aforesaid drawbacks, an engine of second generation was developed. This design is based on the engine design of the aforesaid first generation, having a starter barrel coupled to the one-way bearing for rotating the output shaft of the engine with a drag rope or an electric engine starter as desired. This second generation engine design has the same drawbacks of the aforesaid first generation engine design. Further, an electric engine starter for starting this second generation engine design is quite heavy.

A third generation engine design uses an electric engine starter to start the engine and eliminates the use of a drag rope. According to this third generation engine design an one-way bearing, a partition board and a driven gear are mounted in proper order on a center rod, which extends out of the cylinder block of the engine. The driven gear is meshed with a drive gear at a side cover that is covered on the cylinder block of the engine. The drive gear is affixed to a starter barrel, which is rotatably mounted in a through hole of the side cover and has two longitudinal crevices. An electric engine starter is used and coupled to the longitudinal crevices of the starter barrel, and controlled to rotate the center rod and to further start the engine.

A fourth generation engine design is based on the aforesaid third generation engine design with the exception that the center rod has a flat end; the one-way bearing has an inner diameter fitting the contour of the flat end of the center rod so that the one-way bearing can directly be fastened to the flat end of the center rod.

A fifth generation engine design has a starter block mounted inside the cylinder block of the engine and coupled to the output shaft of the engine, and a side cover covering the cylinder block. The starter block has a coupling tube suspending in the center through hole of the side cove for receiving the starting rod of an electric engine starter to start the engine.

The aforesaid third and fourth generation engine designs are complicated, resulting in a high manufacturing cost. The aforesaid fifth generation engine design is relatively simpler. However, this fifth generation engine design and the aforesaid third and fourth generation engine design have a common problem: after start of the engine, the starting rod of the electric engine starter will be rotated with the starter barrel for a certain length of time before disconnection from the engine. During this stage, the starting rod of the electric engine starter may affect smooth rotation of the engine.

SUMMARY OF THE INVENTION

The present invention has been accomplished to provide an engine starting structure for remote-control toy car, which eliminates the aforesaid drawbacks. It is the main object of the present invention to provide an engine starting structure for remote-control toy car, which enables the user to start the engine with a small electric engine starter without the use of a drag rope. It is another object of the present invention to provide an engine starting structure for remote-control toy car, which is durable in use. It is still another object of the present invention to provide an engine starting structure for remote-control toy car, which has a simple structure and is inexpensive to manufacture. It is still another object of the present invention to provide an engine starting structure for remote-control toy car, which automatically forces the starting rod of the small electric engine starter out of the engine after start of the engine.

To achieve these and other objects and according to one aspect of the present invention, the engine starting structure comprises an engine, the engine having a cylinder block and an output shaft extending out of the cylinder block; a coupling block mounted inside the cylinder block and connected to the output shaft for rotating the output shaft, the coupling block having a rod extending from one side thereof opposite to the output shaft; a starter block mounted inside the cylinder block and coupled to the coupling block, the starter block having a coupling groove transversely disposed in a back side thereof and coupled to the rod of the coupling block and a coupling tube perpendicularly extended from the center of a front side thereof, the coupling tube having a serrated front coupling edge; and a side cover covering the cylinder block, the side cover having a center through hole, which receives the coupling tube of the starter block for enabling the starter block to be rotated with an electric engine starter.

According to another aspect of the present invention, the serrated front coupling edge of the coupling tube of the starter block has two protruded portions and two recessed portions separated by the protruded portions, each recessed portion having a sloping face extending from one of the two protruded portions and a vertical face connected between the sloping face and the other of the two protruded portions. After start of the engine, the sloping face of each recessed portion automatically forces the starting rod of the small electric engine starter out of the side cover by means of an inertia force.

DETAILED DESCRIPTION OF THE INVENTION

Figure 1:
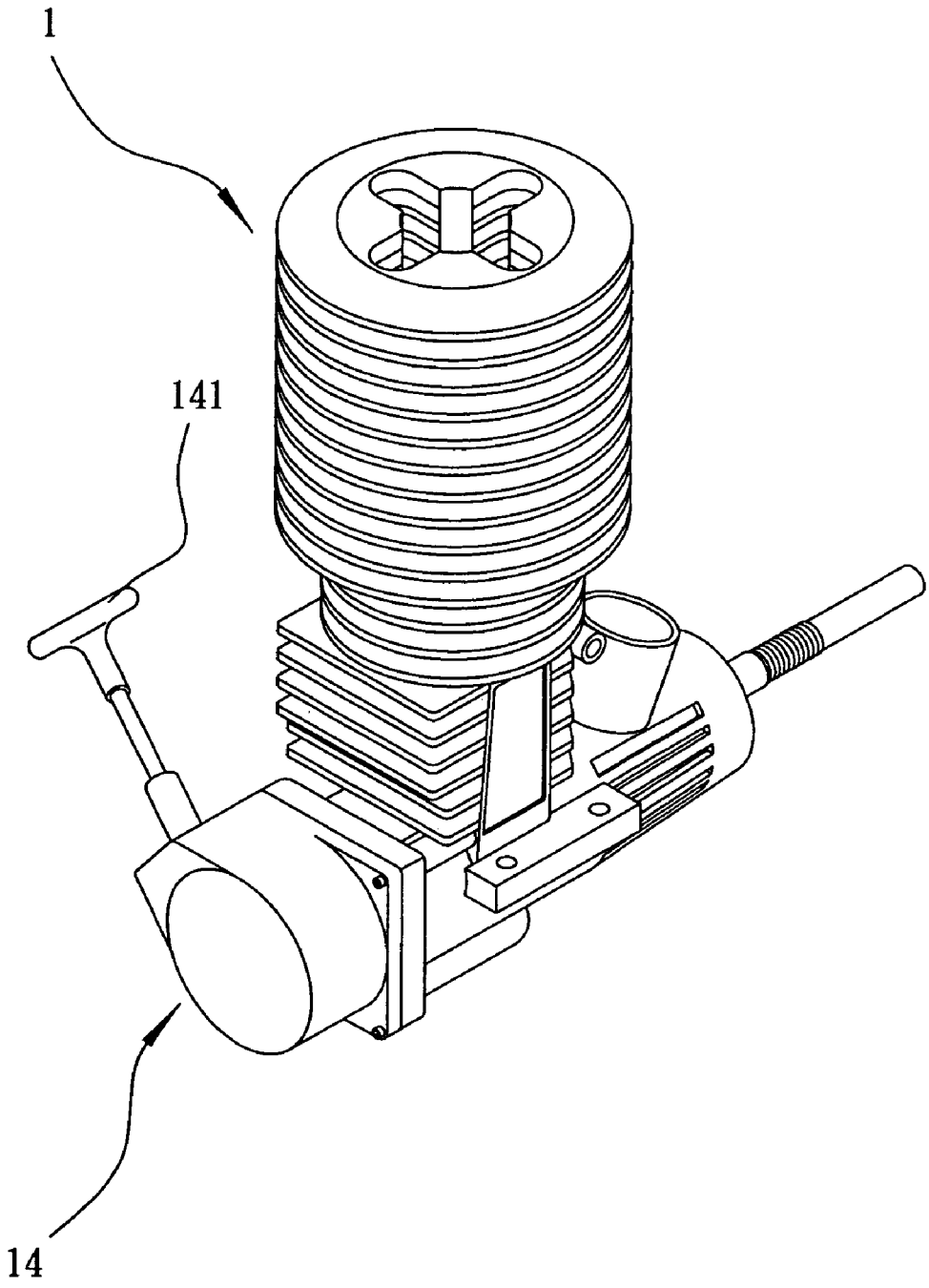
FIG. 1 is an elevational view of an engine starting structure for remote-control toy car according to the prior art.
Figure 2:
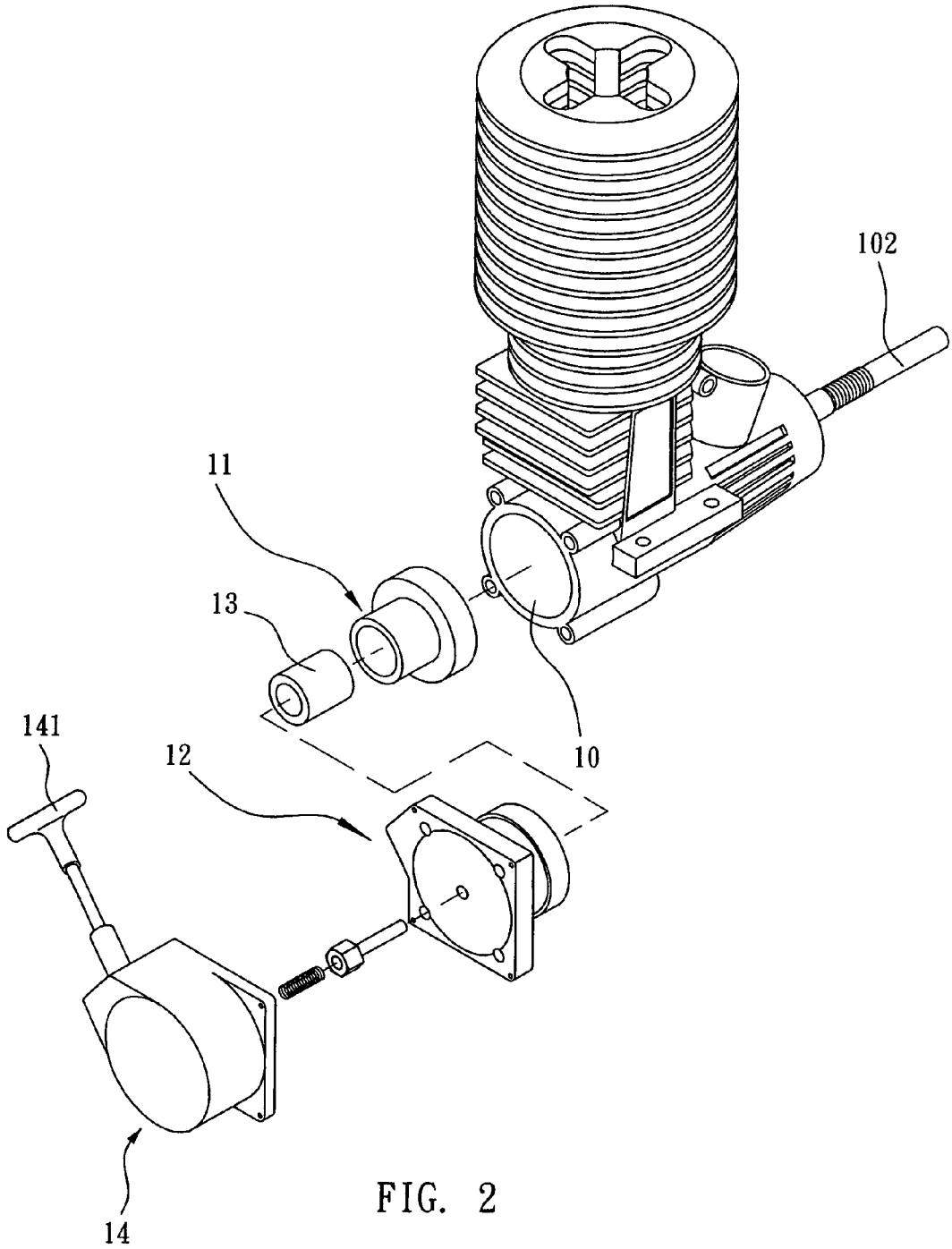
FIG. 2 is an exploded view of the engine starting structure for remote-control toy car according to the prior art.
Figure 3:
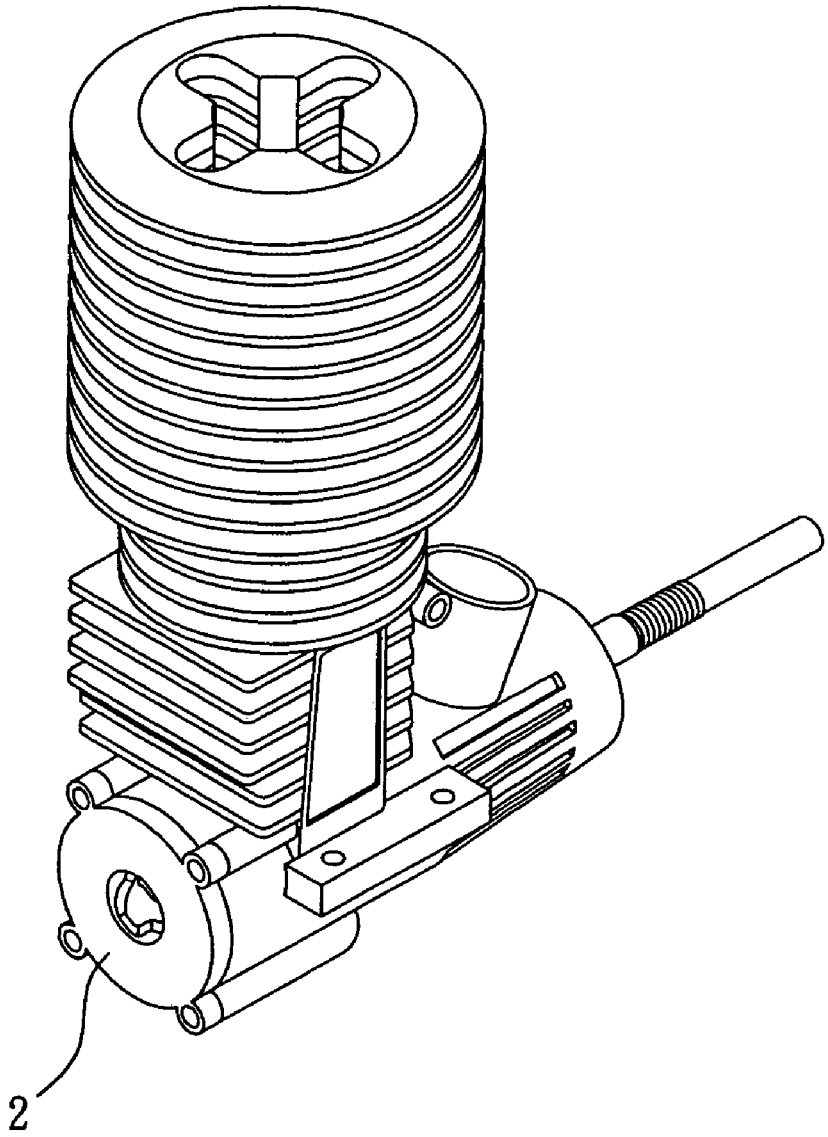
FIG. 3 is an elevational view of an engine starting structure for remote-control toy car according to the present invention.
Figure 4:
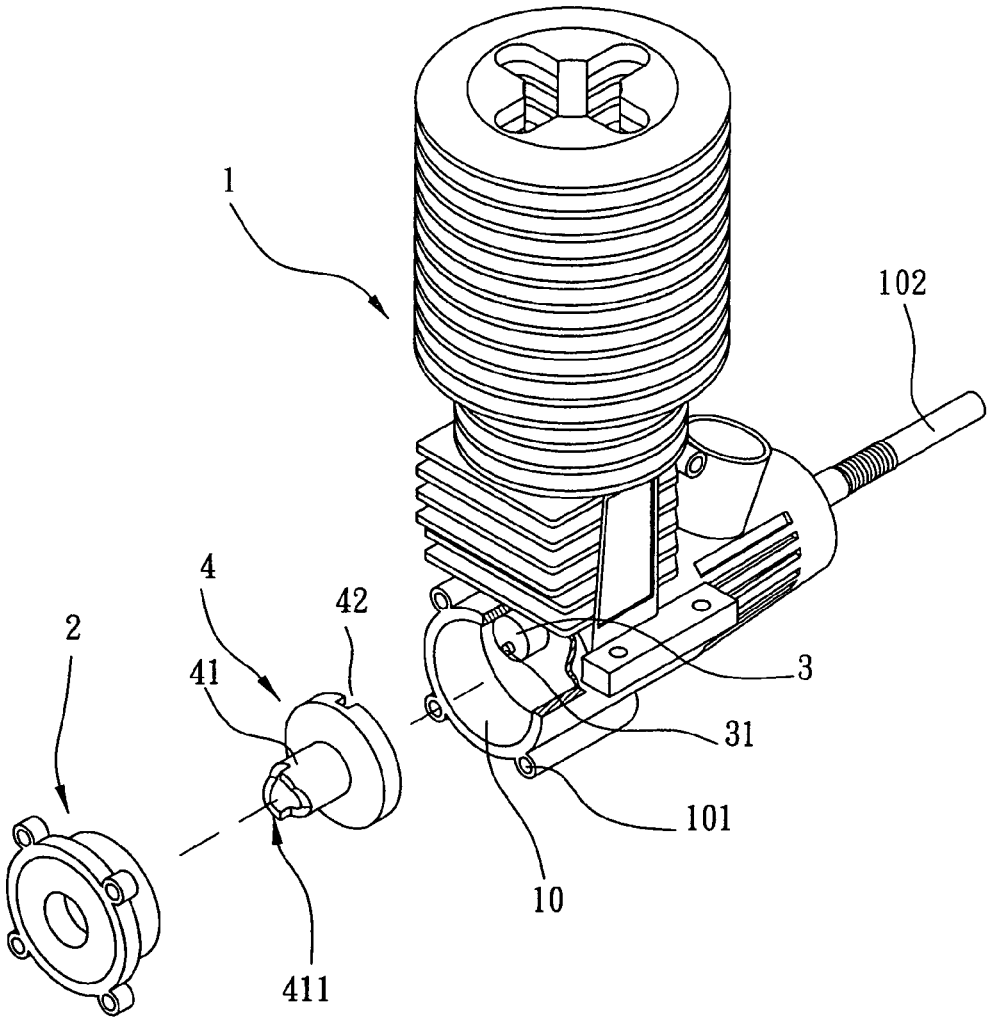
FIG. 4 is an exploded view of the engine starting structure for remote-control toy car according to the present invention.
Figure 5:
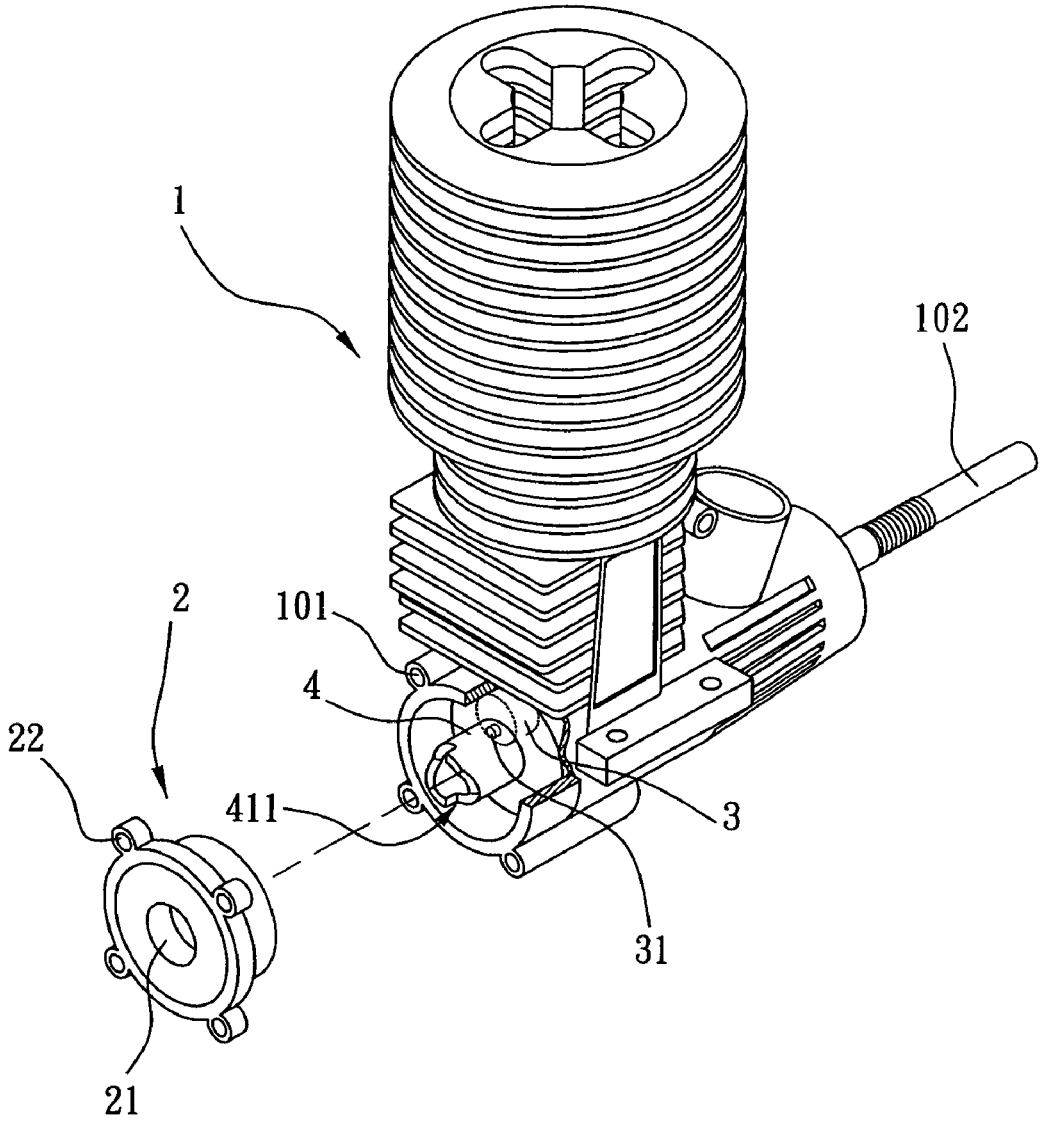
FIG. 5 is similar to FIG. 4 but showing the starting block coupled to the coupling member inside the cylinder block.
Figure 6A:
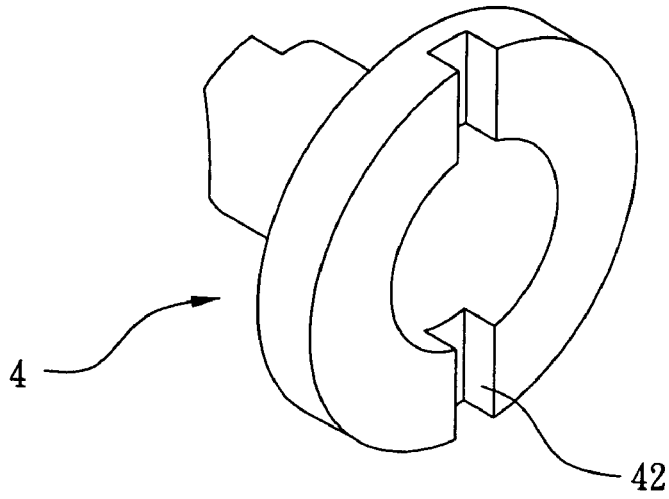
FIG. 6A is an oblique rear elevation of a starter block for the engine starting structure for remote-control toy car according to the present invention.
Figure 6B:
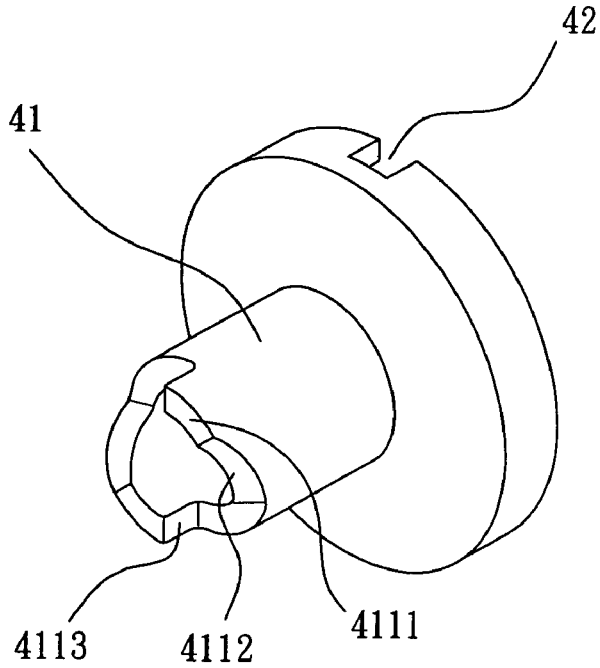
FIG. 6B is an oblique front elevation of the starter block shown in FIG. 6A.

Referring to FIGS. 3~5, an engine 1 is shown comprising a cylinder block 10, an output shaft 102 axially extending out of the cylinder block 10, a plurality of screw holes 101 equiangularly spaced around the cylinder block 10 extending in axial direction an output shaft 102, a circular coupling block 3 mounted inside the cylinder block 10 and coupled to the output shaft 102, the circular coupling block 3 having a rod 31 protruded from one side thereof, a starter block 4 mounted inside the cylinder block 10 and coupled to the circular coupling block 3, and a side cover 2 covering the cylinder block 10.

Referring to FIGS. 6A and 6B and FIGS. 3~5 again, the starter block 4 is a mounted inside the cylinder block 10 and coupled to the circular coupling block 3, having a transversely extended coupling groove 42 transversely disposed at the back side and coupled to the rod 31 of the circular coupling block 3 and a coupling tube 41 perpendicularly outwardly extended from the center of the front side. The coupling tube 41 has a serrated coupling edge 411 formed of two protruding portions 4111 and two recessed portions each having a sloping face 4112 at one side and a vertical face 4113 at the other side. The side cover 2 has a center through hole 21, which receives the center coupling tube 41 of the starter block 4, and a plurality of mounting holes 22 equiangularly spaced around the periphery and respectively fastened to the longitudinal screw holes 101 of the cylinder block 10 with screws (not shown). When assembled, the transversely extended coupling groove 42 of the starter block 4 is maintained engaged with the rod 31 of the coupling member 3, and the serrated coupling edge 411 of the coupling tube 41 is suspended in the center through hole 21 of the side cover 2 in an offset status.

Figure 7:
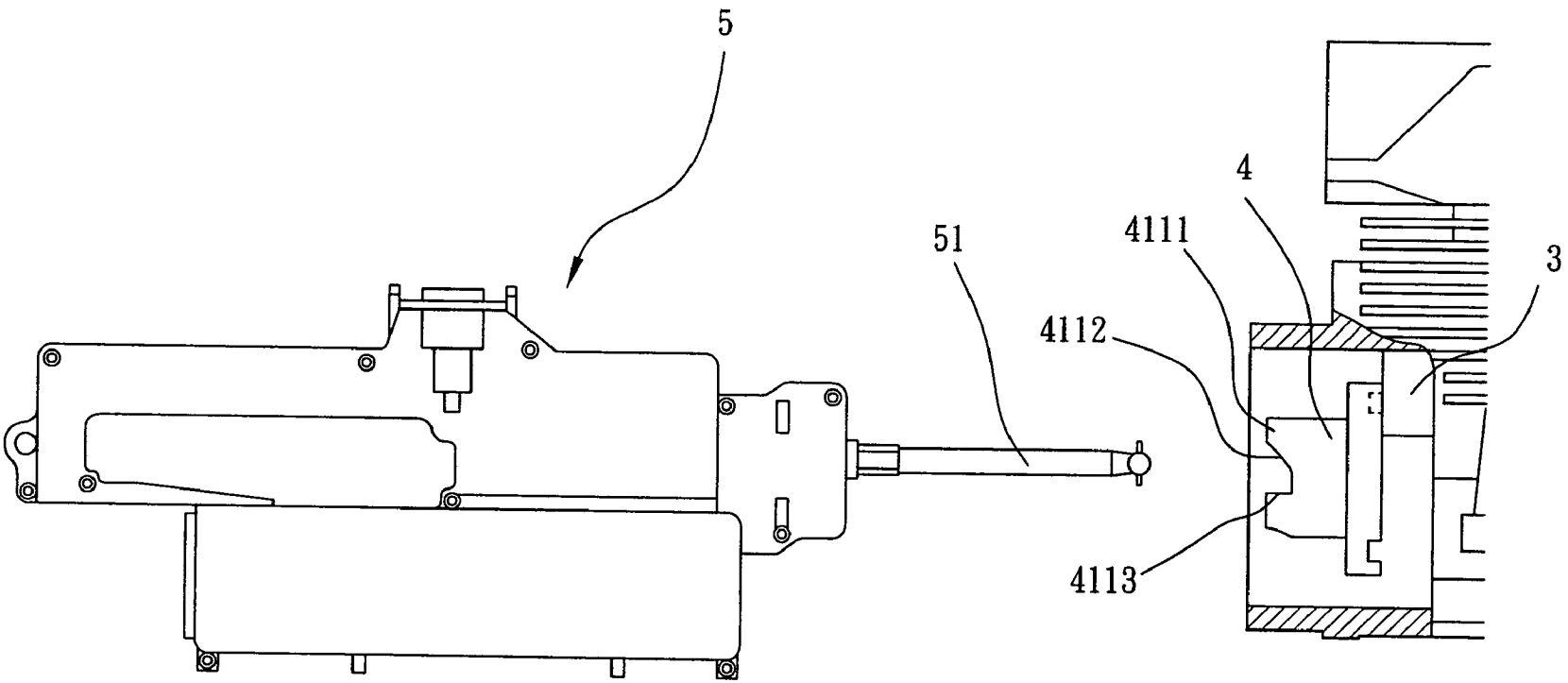
FIG. 7 is a schematic drawing showing the relationship between a small electric engine starter and the starter block in the cylinder block of the engine according to the present invention.

When wishing to start the engine 1, a small electric engine starter 5 (see FIG. 7) is used and inserted with the starting rod 51 into the center through hole 21 of the side cover 2 and attached to the serrated coupling edge 411 between the two protruding portions 4111 for rotating the starter block 4 and the circular coupling block 3 and the output shaft 102 to start the engine 1. When starting the small electric engine starter 5, the crossed front end of the starting rod 51 is forced against the vertical face 4113 of each recessed portion of the coupling tube 41 of the starter block 4, and therefore the starter block 4 is rotated positively. After start of the engine 1, the sloping face 4112 of each recessed portion of the coupling tube 41 of the starter block 4 forces the starting rod 51 out of the starting block 4 and the side cover 2 by means of an inertia force.

A prototype of engine starter structure of an engine has been constructed with the features of FIGS. 3~7. The engine starting structure of an engine functions smoothly to provide all of the features discussed earlier.

Although a particular embodiment of the present invention has been described in detail for purposes of illustration, various modifications and enhancements may be made without departing from the spirit and scope of the invention. Accordingly, the invention is not to be limited except as by the appended claims.

What is claimed is:

1. An engine starting structure comprising:

an engine, said engine having a cylinder block and an output shaft extending out of said cylinder block;

a coupling block mounted inside said cylinder block and connected to said output shaft for rotating said output shaft, said coupling block having a rod extending from one side thereof opposite to said output shaft;

a starter block mounted inside said cylinder block and coupled to said coupling block, said starter block having a coupling groove transversely disposed in a back side thereof and coupled to the rod of said coupling block and a coupling tube perpendicularly extended from the center of a front side thereof, said coupling tube having a serrated front coupling edge; and a side cover covering said cylinder block, said side cover having a center through hole, which receives the coupling tube of said starter block for enabling said starter block to be rotated with an electric engine starter.

2. The engine starting structure as claimed in claim 1, wherein said serrated front coupling edge of said coupling tube of said starter block has two protruded portions and two recessed portions separated by said protruded portions, each said recessed portion having a sloping face extending from one of said two protruded portions and a vertical face connected between said sloping face and the other of said two protruded portions.

* * * * *